US006223837B1

(12) United States Patent
Lanzl

(10) Patent No.: US 6,223,837 B1
(45) Date of Patent: May 1, 2001

(54) DRILLING IMPLEMENT FOR DRILLING HOLES IN THE GROUND

(75) Inventor: Martin Lanzl, Weichering (DE)

(73) Assignee: Bauer Spezialtiefbau GmbH (DE)

( * ) Notice: Subject to any disclaimer, the term of this patent is extended or adjusted under 35 U.S.C. 154(b) by 0 days.

(21) Appl. No.: 09/338,806

(22) Filed: Jun. 23, 1999

(30) Foreign Application Priority Data

Jun. 25, 1998 (DE) ..... 298 11 405 U

(51) Int. Cl.[7] ..... E21B 19/14
(52) U.S. Cl. ..... 175/52; 173/164
(58) Field of Search ..... 175/52, 62, 85, 175/122, 209, 77, 78; 211/70.4, 60.1, 69; 173/164; 414/745, 22; 81/57.15, 57.16, 57.19, 57.2

(56) References Cited

U.S. PATENT DOCUMENTS

Re. 30,071 * 8/1979 Hilding et al. ..... 175/52
3,986,569 * 10/1976 Hilding et al. ..... 175/52
4,084,300 * 4/1978 Narushima et al. ..... 29/568 X
4,501,524 * 2/1985 Yoan et al. ..... 414/22
4,632,618 * 12/1986 Issakainen ..... 414/22
4,834,195 * 5/1989 Robinson ..... 175/52
5,954,209 * 9/1999 Wurn et al. ..... 211/70.4

* cited by examiner

*Primary Examiner*—Robert E. Pezzuto
(74) *Attorney, Agent, or Firm*—Elizabeth Stanley; Pepper Hamilton LLP

(57) ABSTRACT

The invention relates to a drilling implement for drilling holes in the soil. In known drilling implements, drilling tools, such as drill tubes or drill rods, are stored and handled via magazines and magazine forms which require a considerable outlay on sensors and control engineering in order to position the drilling tools. In the drilling implement according to the invention, there is provision for stops to be provided as mechanical travel-limiting mechanisms when the drill tubes are being positioned in respective functional positions. This obviates the need for sensor and control devices which are expensive and susceptible to faults.

16 Claims, 13 Drawing Sheets

DRILLING IMPLEMENT FOR DRILLING HOLES IN THE GROUND

This application claims priority to German Utility Model Application No. 298 11405.4, filed Jun. 25, 1998, which is incorporated herein by reference.

FIELD OF THE INVENTION

The invention relates to a drilling implement for drilling holes in the ground, having a mounting, a drill drive, which is arranged displaceably on the mounting, for drilling tools, such as drill tubes or drill rods, a linear magazine, which is arranged on the mounting, in which the drilling tools can be stored in a magazine in a plane parallel to the mounting and which can be displaced in this plane by means of a drive device, and a clamping device for the selective rotational fixing of the fitted drill string and a drill tube which can be connected thereto and is arranged in the drilling axis.

BACKGROUND OF THE INVENTION

Hitherto, drill rods have been stored and handled by means of various magazines and magazine forms. For example, document DE 40 30 525 C2, which portrays the generic device, has disclosed a rod magazine for a rock drill machine, which magazine has two receiving devices which are spaced apart, are arranged on a mounting which supports a drill drive and each have a guide fork for accommodating drill stems in a parallel plane to the mounting. By means of hydraulic cylinders, the receiving devices can be displaced toward the drilling axis until the drill stem which is to be removed from the receiving device bears against a guide surface and is released from the receiving device. Then, it is screwed to the drill string. These movements are controlled with the aid of contactless switches with electronic switching elements which interact with switching lugs. Such a complex arrangement of sensors does not rule out the possibility of incorrect functional sequences, owing to the sensitivity of the switching elements to the severe operating conditions involved in the use of a drilling implement.

DE 297 03 271 U1 has disclosed a drilling implement with a rotable drum magazine for drill tubes which is arranged on a mounting, in which implement a handling device is provided for removing the drill tubes from the drum magazine; this handling device has a telescopic gripper arm with a gripper. However, a considerable outlay on control engineering is required for the fully mechanized actuation of the handling device.

SUMMARY OF THE INVENTION

Therefore, the invention is based on the object of improving a drilling implement of the type described above in such a manner that the rod can be inserted from a rod magazine into the drill string or the rod can be removed from the drill string and stored in the rod magazine, without the need to use the sensor devices which have hitherto been customary and are susceptible to faults in order to control the sequence.

According to the invention, the object is achieved by the fact that, in the drilling implement outlined above, stops are provided as mechanical travel-limiting means when the drill tubes are being positioned in respective functional positions.

Positioning the drill tubes against mechanical travel-limiting means obviates the need for a control device with a high risk of the sensors failing. Nevertheless, an operator of such a drilling implement can carry out the magazining and transfer operations without difficulty and without significantly increasing the nonproductive times when drilling.

Advantageous configurations of the invention are given in the subclaims.

Expediently, the stops are provided in the drive device for the linear magazine and fix magazining and transfer positions for the drill tubes. The stops are, for example, the limit positions of movement paths of piston-cylinder units of the drive device, so that the linear magazine is ineluctably arranged in the desired positions.

Furthermore, it is advantageous if a stop is formed, as a rod support, on a stationary rod chuck of the clamping device. As a result, a limit position is defined directly by a drill tube which is arranged in a longitudinal axis of the drilling string or in the drilling axis and is then screwed to the drill string.

If different receiving contours can be set on the rod support, in order to match different diameters of drill tubes, the drilling implement can be employed universally by changing these contours.

This change in the contours can be carried out by means of an adjustment device for movable contours. As an alternative, rod supports with different receiving contours may be fitted to the rod chuck as desired.

In an advantageous embodiment, the linear magazine has two spaced-apart receiving devices for the drill tubes.

Tube holders for clamping a drill tube in a transfer position in the linear magazine may be arranged on the receiving devices. By means of the tube holders, the front drill tube may in each case be clamped onto the receiving device and can be conveyed into the transfer position in the drilling axis, where it can be screwed to the drill string.

According to an advantageous refinement of the invention, the linear magazine contains a preloading device which presses the drill tubes which are stored in the magazine toward the drill tube which is clamped in the tube holders. This simplifies the functional sequence involved in removing a drill tube from the liner magazine.

If the linear magazine can be displaced with respect to the mounting by way of its receiving devices and, by means of respective limit stops on the movement paths of the drive devices, can be positioned in different, in particular three, functional positions, an operator can move the magazine into these positions in a simple manner.

Expediently, the receiving devices contain holding forks, which receive and guide the stored drill tubes in a holding fork opening.

The universal usability of the drilling implement is further enhanced by the fact that adapter elements can be fixed to the holding forks in order to adapt to different drill-tube diameters.

The fact that the translational movement of the receiving devices and/or of the holding forks is synchronized by hydraulic or mechanical synchronization of the two drive devices means that the drill tubes are always moved exactly into the drilling axis, without the operator having to act specifically to ensure this.

For simple adaptation to different drill-tube diameters, it is also possible to fit spacer rings to the drive devices.

If, according to a further configuration of the drilling implement according to the invention, it is possible to adjust the positioning of a means for attaching the drive device to a support of the mounting, it is possible, in a simple manner, to adapt the linear magazine to different transmissions with different distances between the drilling axis and the mounting.

BRIEF DESCRIPTION OF THE DRAWINGS

The invention is explained in more detail below on the basis of an exemplary embodiment of a drilling implement according to the invention and with reference to drawings, in which.

DETAILED DESCRIPTION OF THE PREFERRED EMBODIMENT

Figure 1:
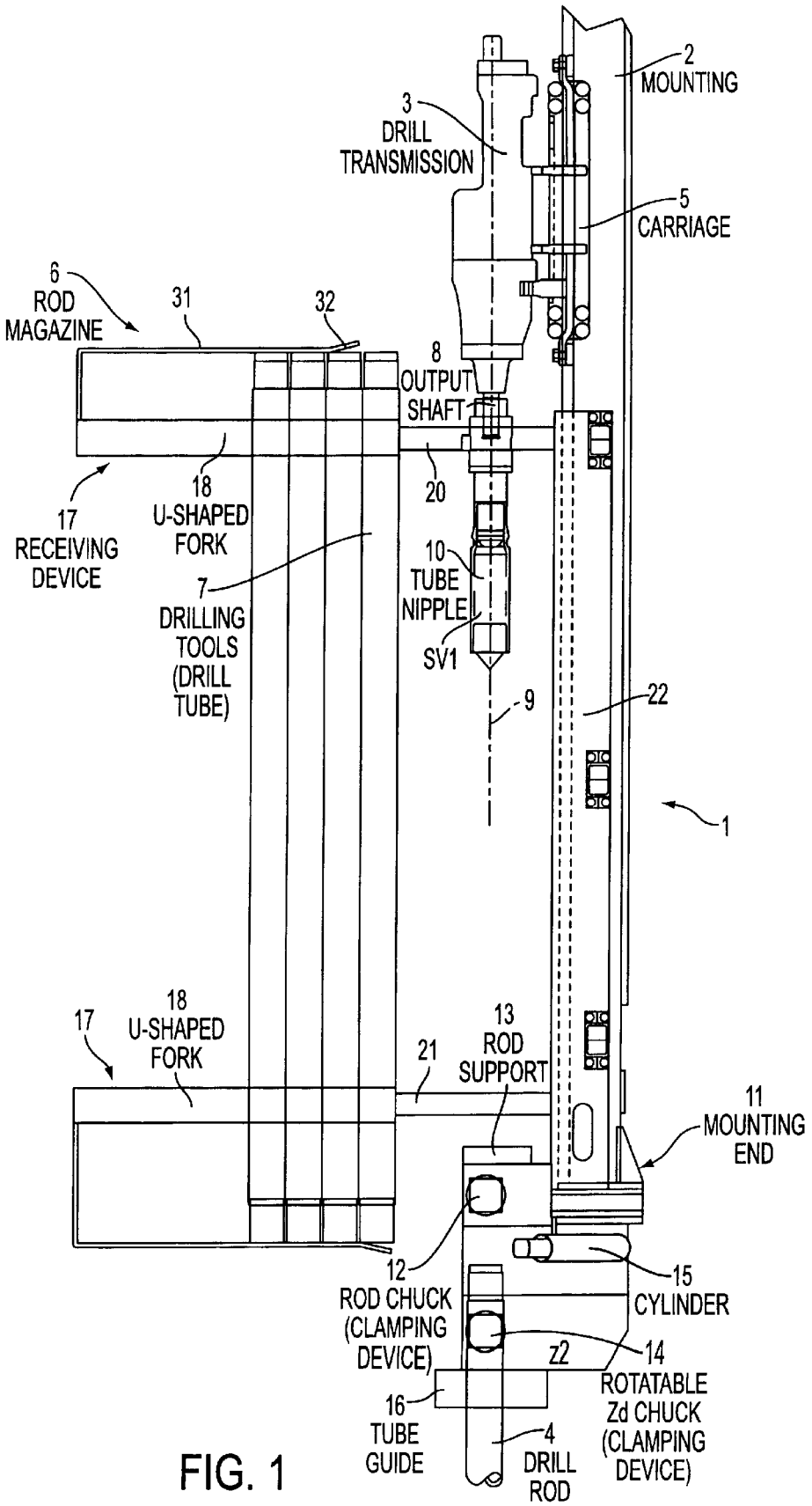
FIG. 1: shows an overall view of a drilling implement with a rod magazine according to the invention.

A drilling implement 1 has a mounting 2, on which a drill transmission 3 of a drill drive for a drill rod 4 is mounted in a longitudinally displaceable manner by means of a carriage 5. Only those components of the drilling implement 1 which are required in order to describe the invention are shown, and the implement may be arranged and positioned on a drill carriage, as described, for example, in DE-A 38 19 537. A rod magazine 6 for receiving and storing drilling tools 7, such as drill tubes, drill stems or rod stands is arranged on the mounting 2. Naturally, the drilling implement is suitable for making holes in any type of ground, such as soil, lithosol or rock.

Figure 15:
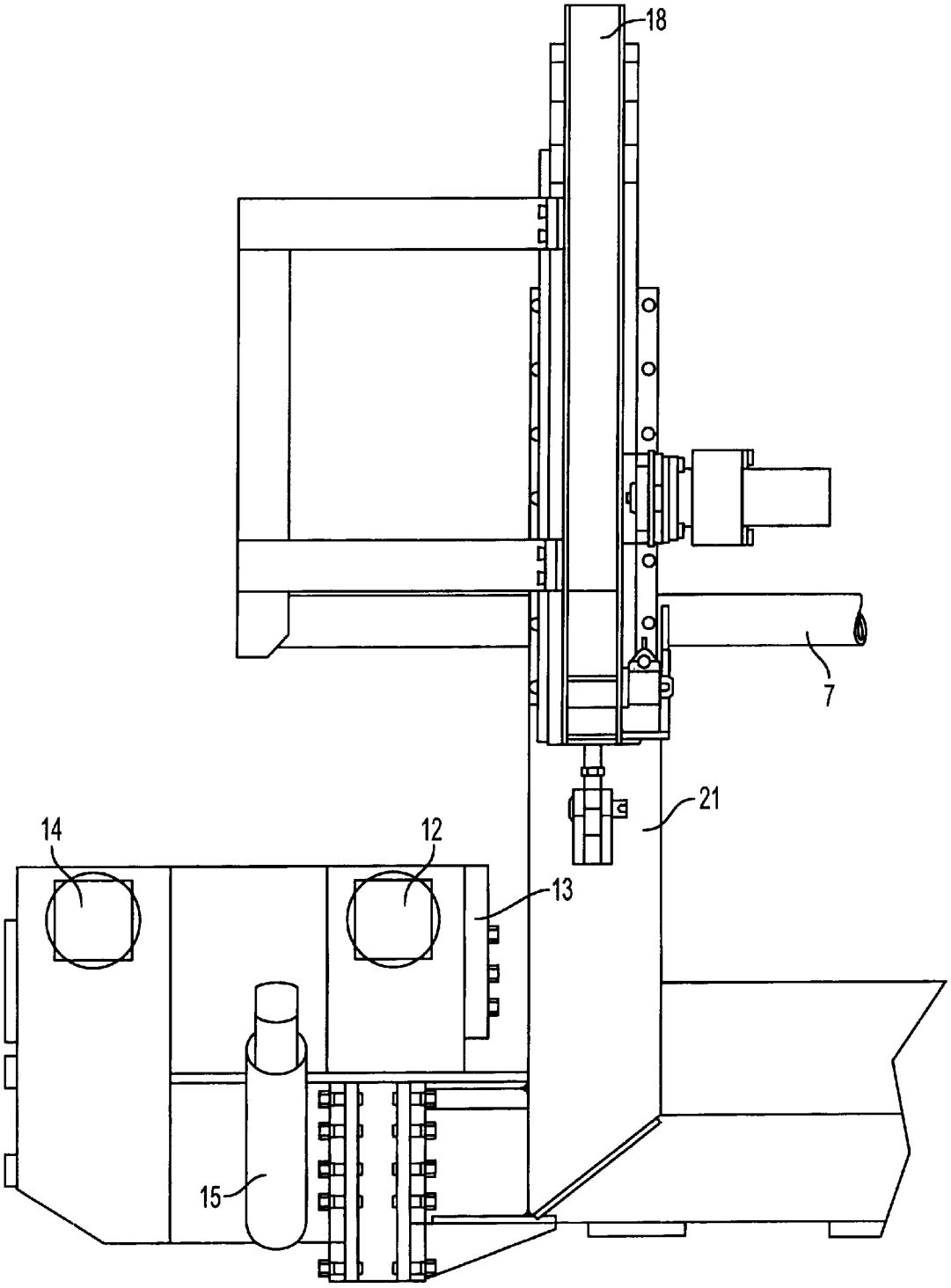
FIG. 15: shows a side view of the drilling implement in accordance with FIG. 1, at its chuck-side end.
Figure 16:
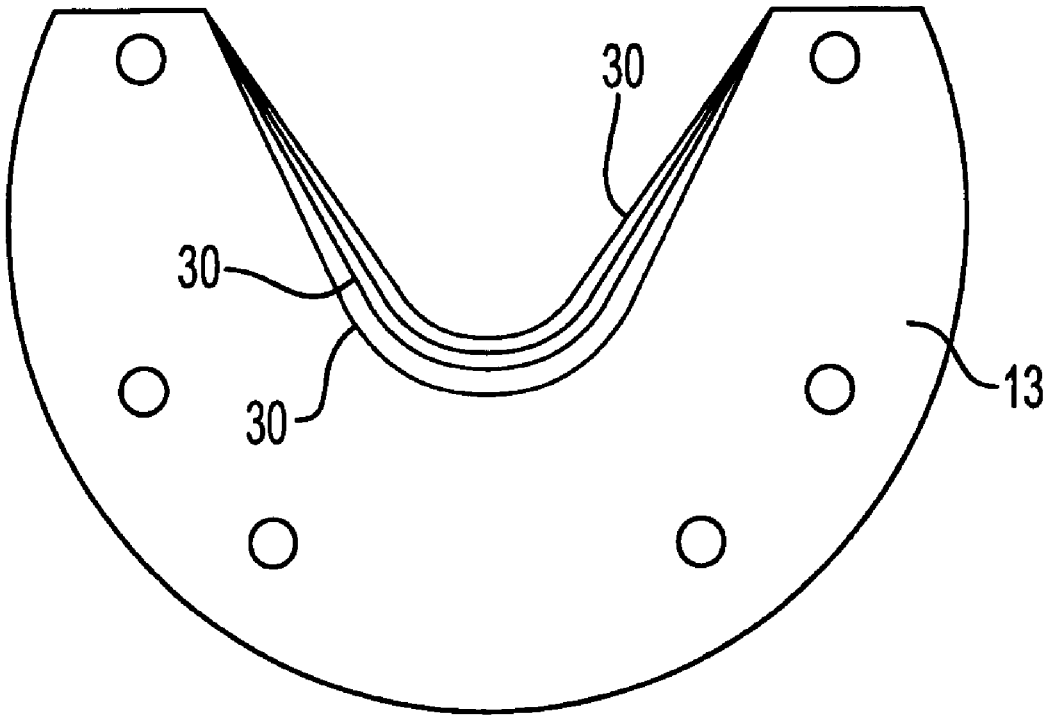
FIG. 16: shows a plan view of a rod support.

A drill string coupling, which is also known as the transmission-side tube nipple 10, is attached to an output shaft 8 of the drill transmission 3, and therefore coaxially with respect to a drilling axis 9. At its end 11 which is on the drilled-hole side, the mounting 2 has a stationary first rod chuck 12 with a rod support 13, which forms a mechanical travel-limiting means or a stop for a drill tube 7. The rod support 13 is a plate which is detachably connected to the chuck 12 (cf. in particular FIG. 15) and, due to its contour 30 (cf. FIG. 16), centers the rod or drill tube 7 in the drilling axis 9. Depending on the diameter of the drill tubes 7 used, it is necessary to use a suitable rod support 13 with the associated contour 30 (FIG. 16 shows the rod support 13 with four contours, representing four rod supports for the different diameters). FIG. 15 shows a drill tube 7 which is held in the holding fork 18 before it is placed in the rod support 13.

Between this stationary first chuck 12 and a rotable second chuck 14, which is arranged at a distance from the first chuck in the direction of the drilling axis, there is a rod-breaking cylinder 15 which, by the way in which it is coupled, is able to rotate the first chuck 12 relative to the second chuck 14, by adopting a retracted position and an extended position. The second chuck 14 contains a tube guide 16 for centering and guiding the drill string or drill rod 4.

Figure 2:
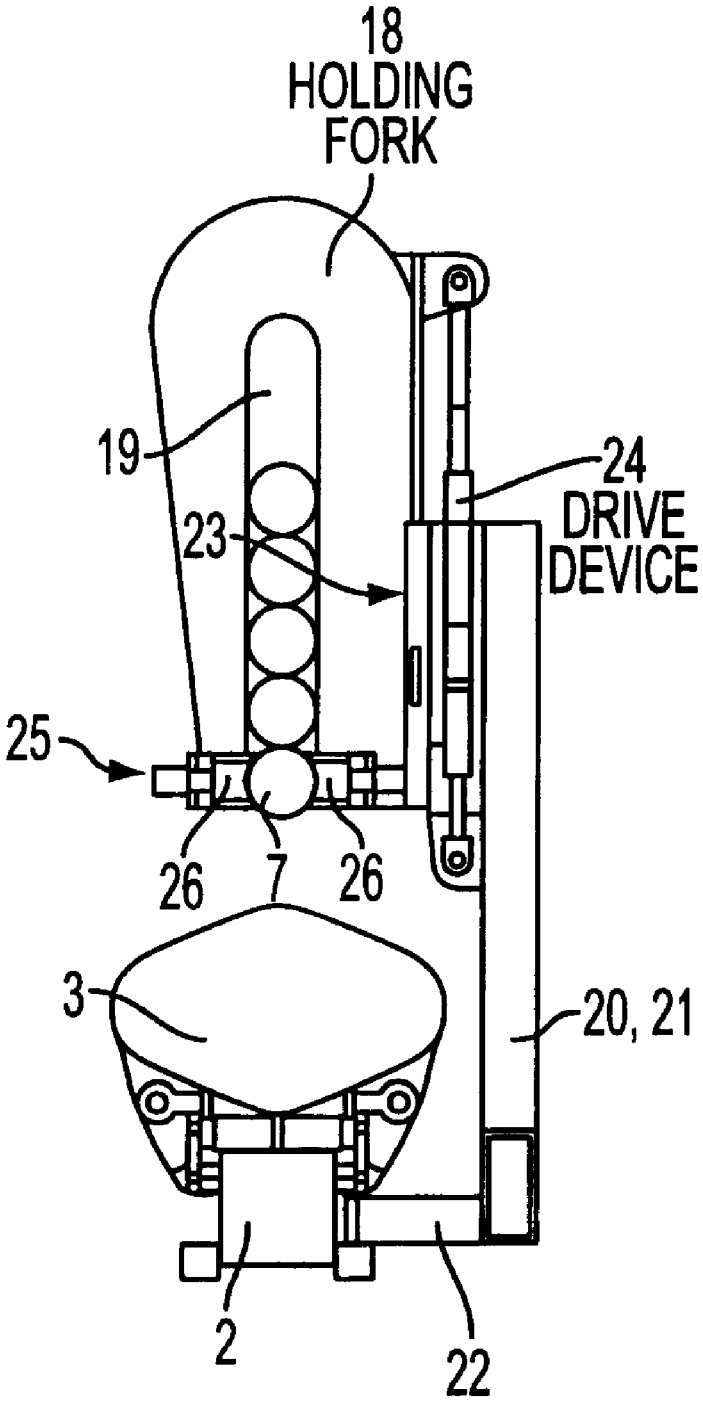
FIG. 2: shows a side view of the drilling implement shown in FIG. 1, in the direction of the drilling axis.

The rod magazine 6 has a receiving device 17 for the drilling tools or drill tubes 7, with two U-shaped holding forks 18 which are spaced apart from one another (cf. FIG. 2) and are arranged in such a way that their openings 19 for the drill tubes 7, which openings extend in linear fashion, open toward the drilling axis 9 of the drill transmission 3 and intersect this axis. Thus, the drill tubes 7, which are stored in the rod magazine 6, also known as linear magazine, are arranged next to and parallel to one another in a plane which is parallel to the drilling axis 9. Axial guides, such as for example guide plates 31, are arranged on the holding forks 18, which plates guide the drill tubes 7 axially in the rod magazine 6. They may have a run-in slope 32. The two holding forks 18 are arranged on a transmission-side support 20 or on a drilled-hole-side support 21 which is spaced apart from the transmission-side support, which supports are attached to the mounting 2 via a longitudinal rail 22 and can be displaced perpendicularly with respect to the drilling axis 9 by way of guides 23 provided on the supports 21, 22.

The holding forks 18 are driven by means of respective drive devices 24, such as piston and cylinder devices, which have, for example, a tandem cylinder, two cylinders connected in series or a controlled-displacement cylinder. The piston and cylinder devices are operatively connected between the support 20 or 21 and the respective holding fork 18, so that the holding forks 18 can be displaced, and in particular can adopt three positions, which also represent the position of the rod magazine and are described in more detail below. The movements of the two holding forks 18 between the three positions (starting position in accordance with FIGS. 3A and 3B, transfer position in accordance with FIGS. 4A and 4B, for example, advancing position in accordance with FIGS. 7A and 7B, for example) are mechanically limited by means of the tandem cylinders or by means of the series connection of two cylinders. When the rod magazine 6, together with the holding forks 18, is in the starting position, both sides of the tandem cylinder or both series cylinders are extended. If the rod magazine 6, together with the holding forks 18, is in the transfer position, the tandem cylinders are retracted on both sides (or both series-connected cylinders are retracted) . If the rod magazine 6, together with the holding forks 18, is in the advancing position, the first side of the tandem cylinder is extended (or the first cylinder of the series cylinders is extended) . Thus the displacement paths of the two holding forks 18 are mechanically limited by means of the limit positions of the cylinders of the drive devices 24.

Synchronous translational movement of the two holding forks 18 is achieved by means of a hydraulic or mechanical synchronization of the two drive devices 24. Each holding fork 18 has a tube holder 25 for a drill tube 7 which is situated in the magazine or holding fork opening 19, at the most forward position, or removal position. The tube holder 25 comprises one or, for example, two opposite pressure pistons 26 which can be actuated hydraulically, can move toward one another, in a closed position clamp the drill tube 7 between them and in an open position are able to release this tube again.

The receiving device 17 or the two holding forks 18 may have a preloading device (not shown) which presses the other drill tubes 7 stored in the magazine toward the drill tube 7 which is being held in the tube holders 25.

The sequence of operations involved in manipulation of the individual drilling tools 7 or rod stands when the drill string 4 is being used to carry out the drilling operation and during the subsequent pulling of the drill string, and therefore during the associated insertion and removal of the individual drilling tools 7 into and from the magazine, is described with reference to FIGS. 3 to 14.

Figure 3B:
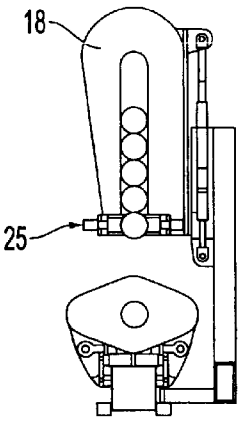
FIGS. 3 to 14: each show two views, corresponding to FIG. 1 and FIG. 2, of different movement positions of the drilling implement when drill tubes are being removed from the magazine.
Figure 3A:
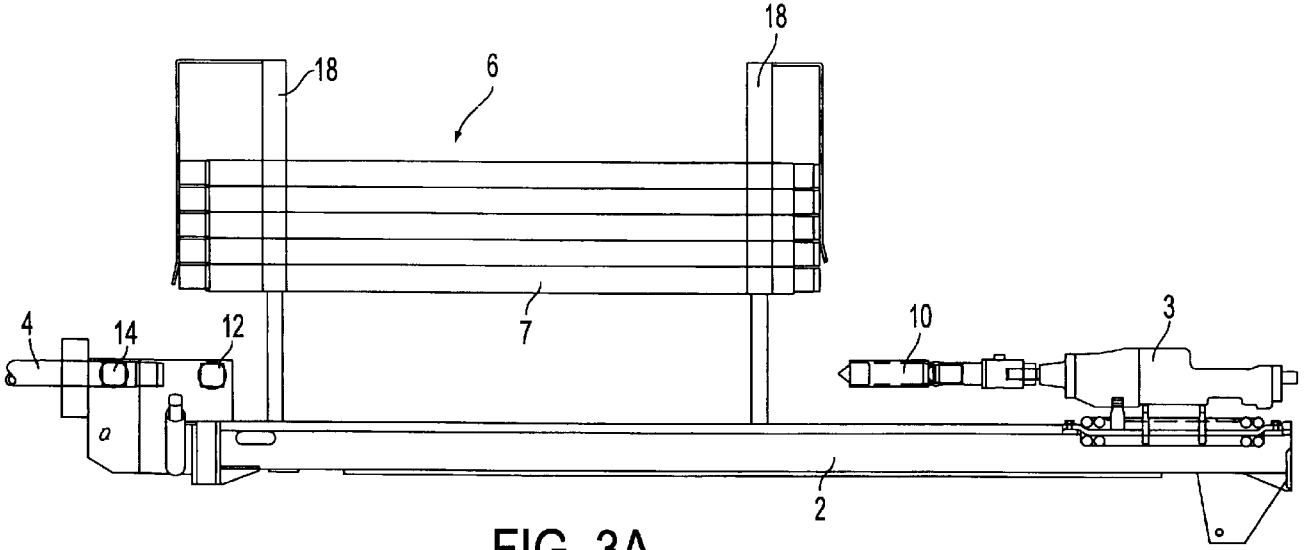

FIGS. 3A and 3B shows the drilling implement 1 in a starting position. The rod magazine 6, together with the two holding forks 18 and the stored drill tubes 7, is in a position which is remote from the mounting 2 and, with regard to the mounting 2 which is illustrated in the horizontal position, is also known as the upper position. The tube holders 25 hold the drill tube 7 which is situated at the furthest forward or lowest position in the holding fork opening 19 clamped in place. The first chuck 12 is open, while the second chuck 14 is closed. The drill transmission 3, together with its attachments, such as the tube nipple 10, has been moved out of the area of the rod magazine 6.

Figure 4B:
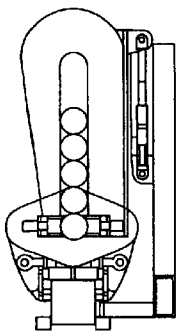
Figure 4A:
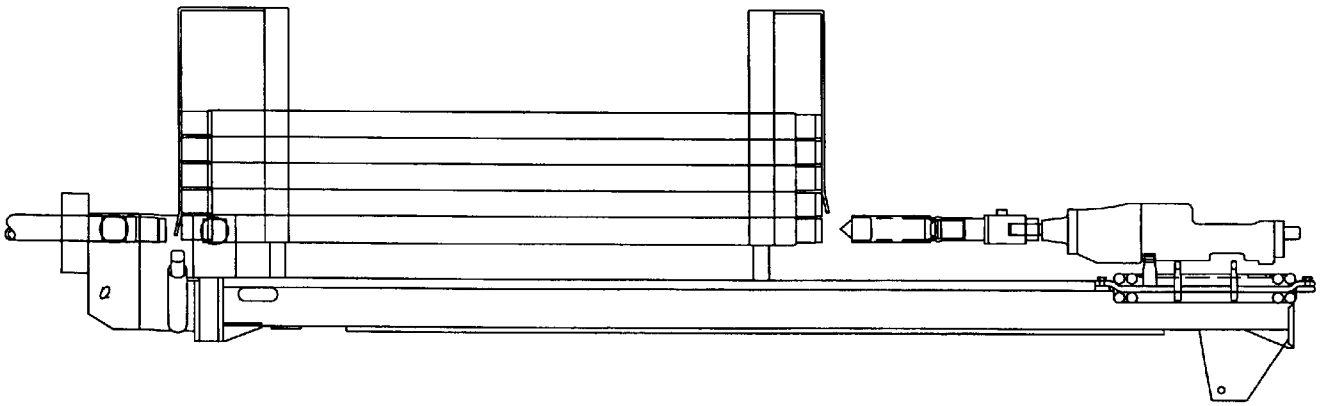
Figure 5B:
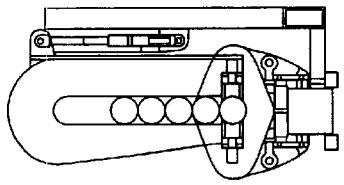
Figure 6B:
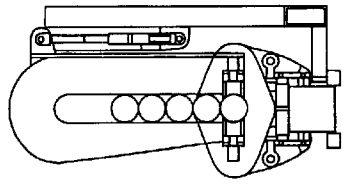
Figure 5A:
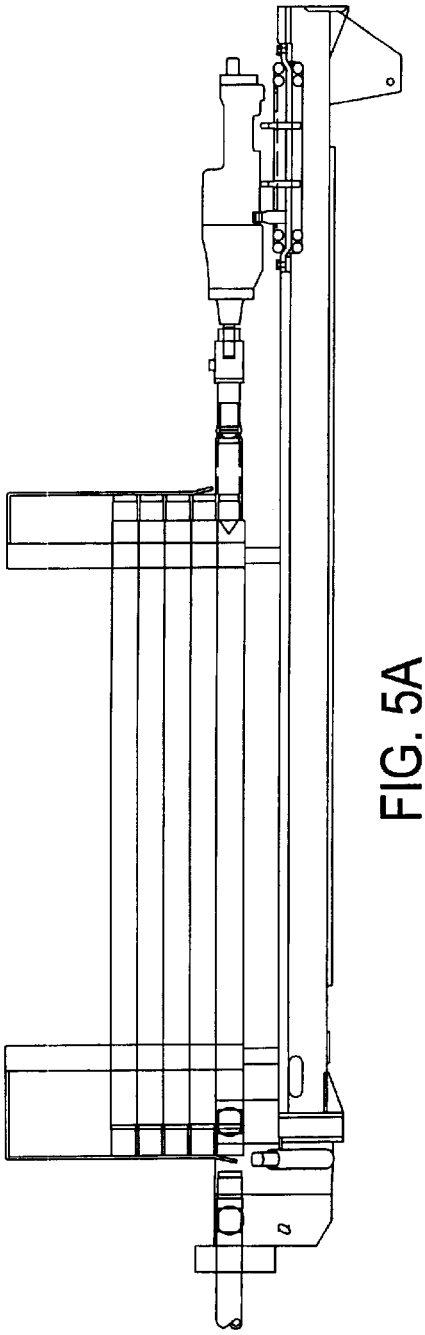
Figure 6A:
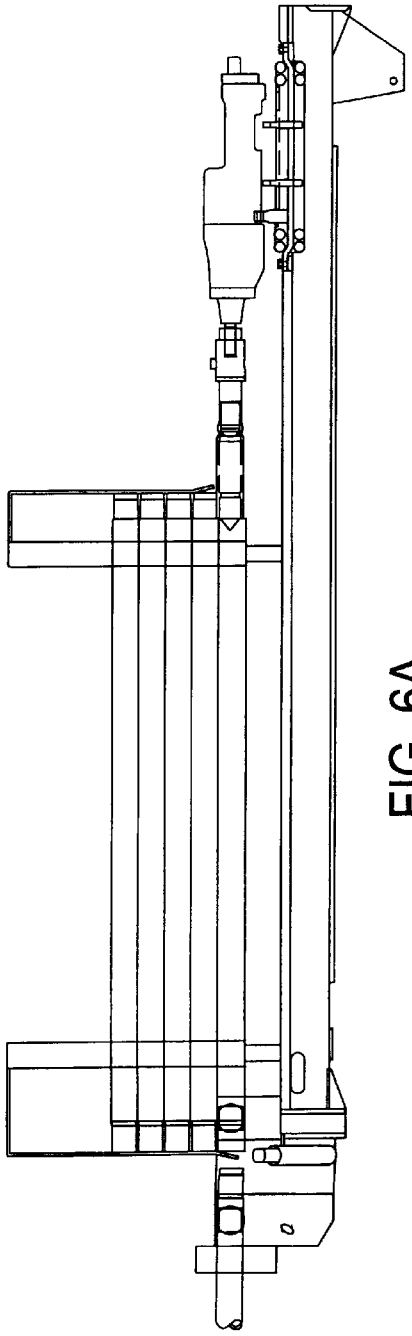

The rod magazine 6 is then displaced toward the mounting 2 (downward as seen in the figures) until the rod magazine 6 or the drill tube 7 bears against the stop 13 (cf. FIGS. 4A and 4B). The first chuck 12 is closed.

Then (cf. FIGS. 5A and 5B), the transmission-side tube nipple 10 is screwed to the drill tube 7 which is arranged in a rotationally fixed position in the drilling axis 9, by means of suitable, superimposed advance and rotational movements of the drill transmission 3. The tube holders 25 continue to hold the drill tube 7 securely in the holding fork opening 19. The drill transmission 3 has moved into a first intermediate position, in which the drill tube 7, which has been screwed to the tube nipple 10, is still arranged beneath the rod magazine 7, that end of the drill tube 7 which faces the drill string 4 lying securely in the first chuck 12. This represents the transfer position of the rod magazine 6 and of the drill tube 7.

Figure 7B:
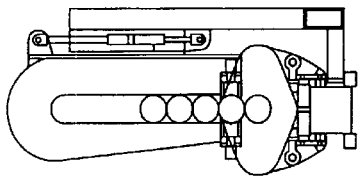
Figure 7A:
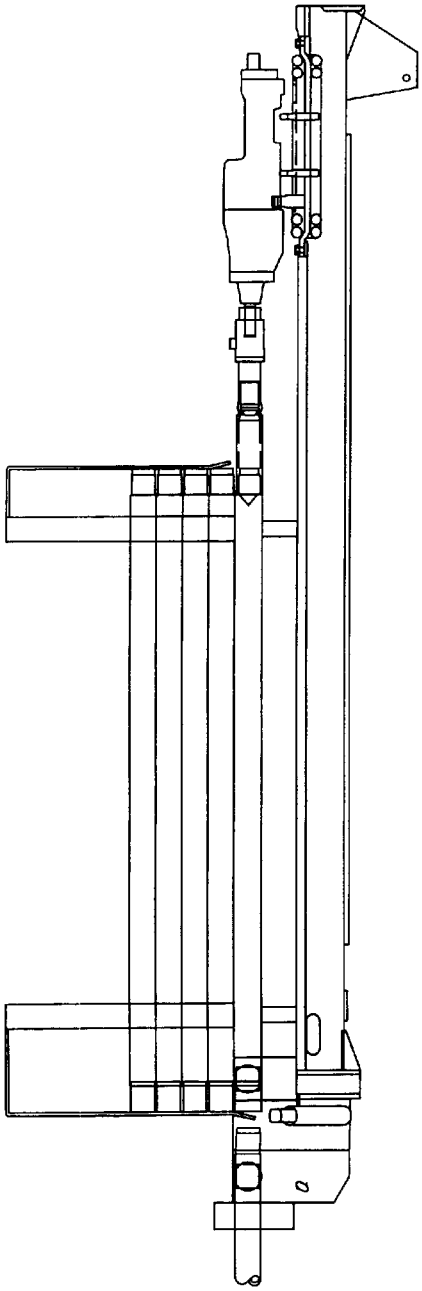

The tube holders 25 are opened (FIGS. 6A and 6B) and the rod magazine 6 is moved upward by one tube position, i.e. by the distance which approximately corresponds to the diameter of one drill tube 7 (FIGS. 7A and 7B). Since the tube holders 25 are open, the other drill tubes 7 which are stored in the magazine are not moved with it, but rather remain bearing against one another due to the preloading device.

Figure 8B:
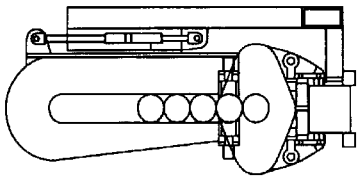
Figure 8A:
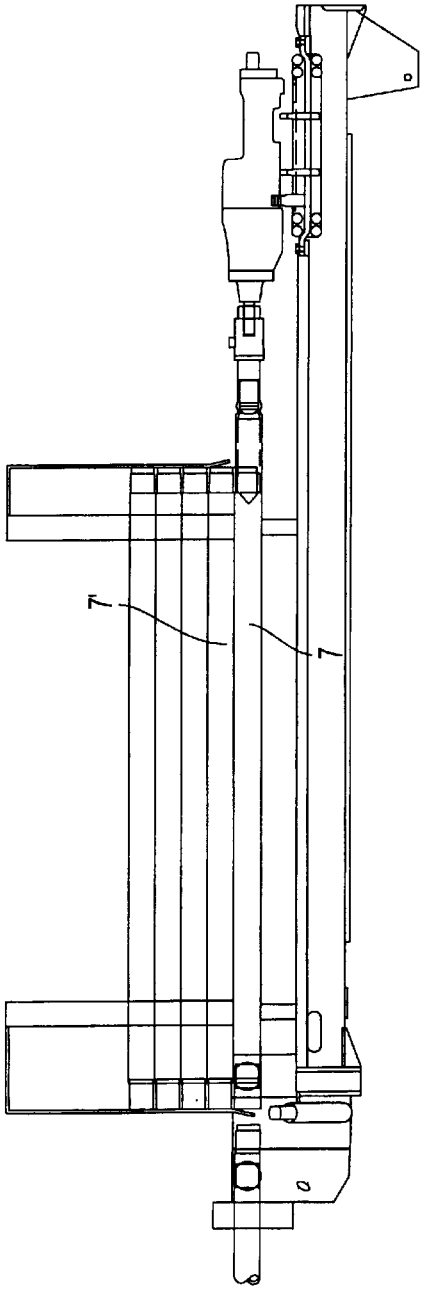
Figure 9B:
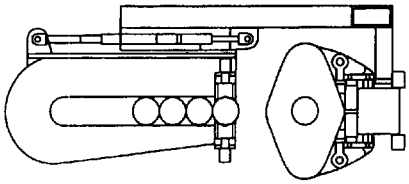
Figure 10B:
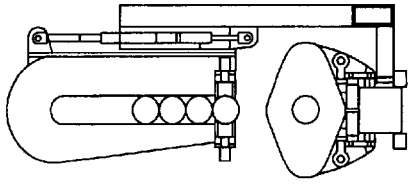
Figure 9A:
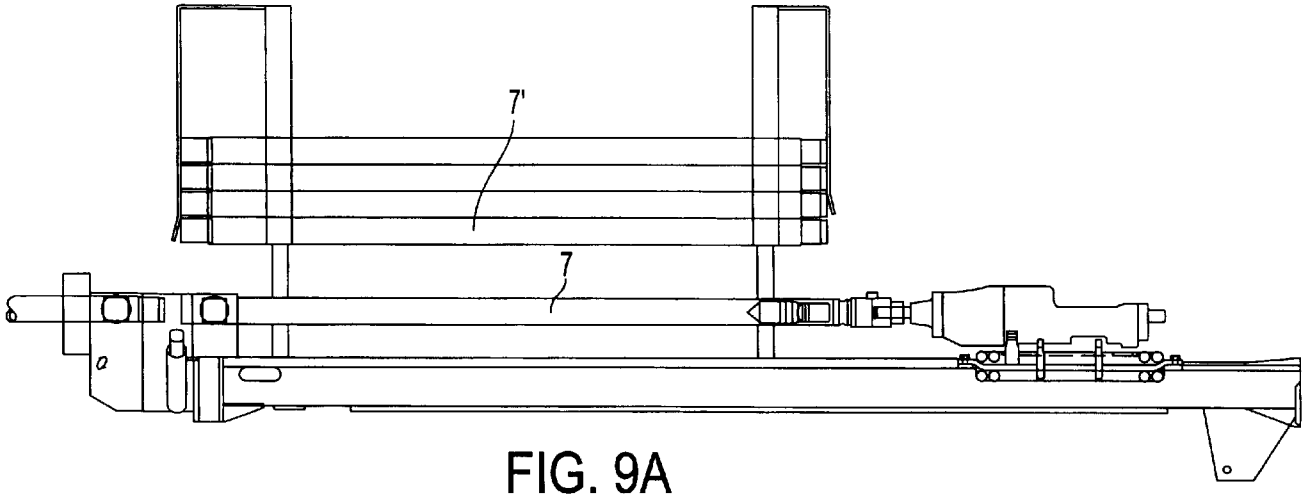
Figure 10A:
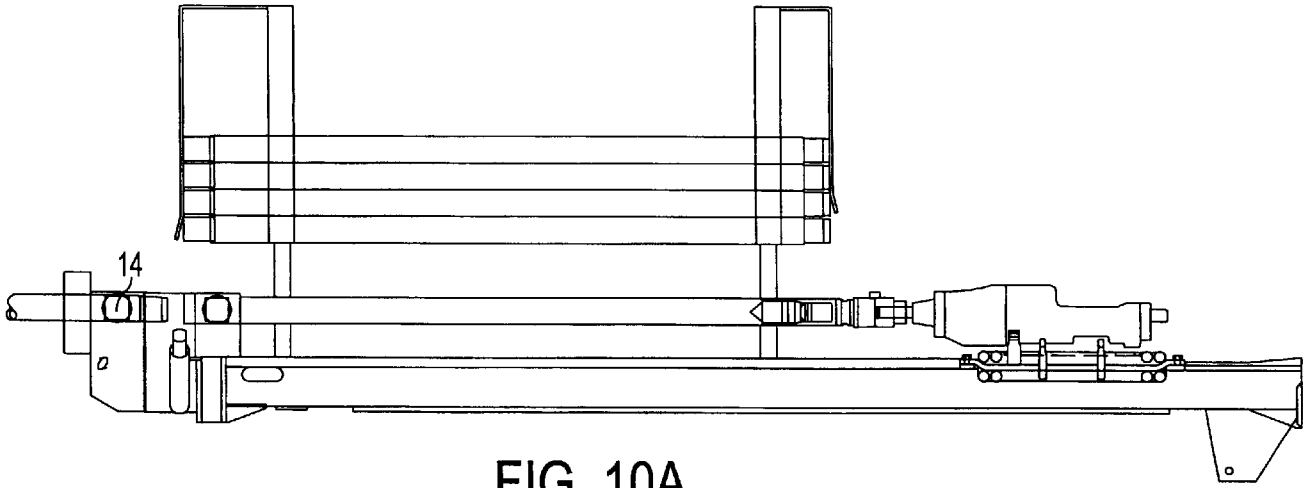

The tube holders 25 are closed and clamp the next drill tube 7', which is adjacent to the drill tube 7 arranged in the drilling axis 9 (FIGS. 8A and 8B). The rod magazine 6 is moved upward into the starting position, taking all the drill tubes situated in the holding fork opening with it. Then, by means of superimposed advance and rotational movements of the drill transmission 3 (FIGS. 9A and 9B), the drill tube 7 is screwed to the drill string 4. The drill transmission 3 in the process moves into a second intermediate position.

Figure 11B:
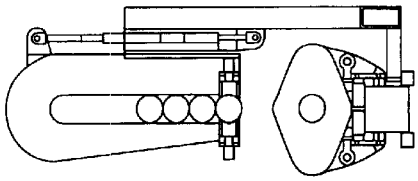
Figure 12B:
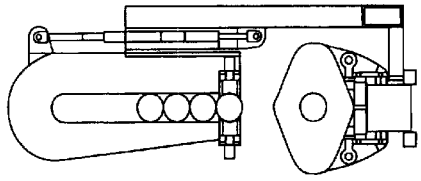
Figure 11A:
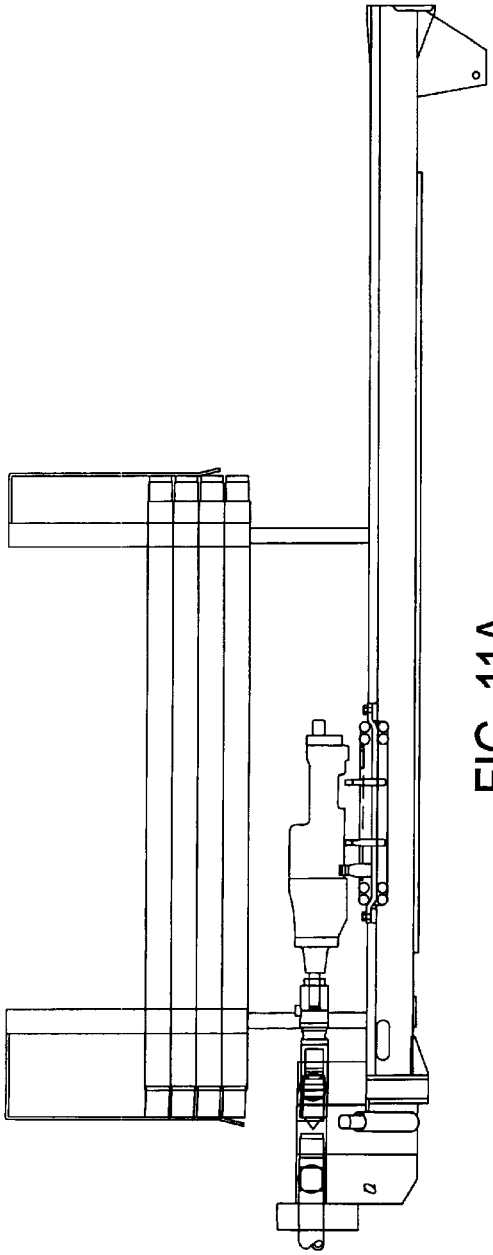
Figure 12A:
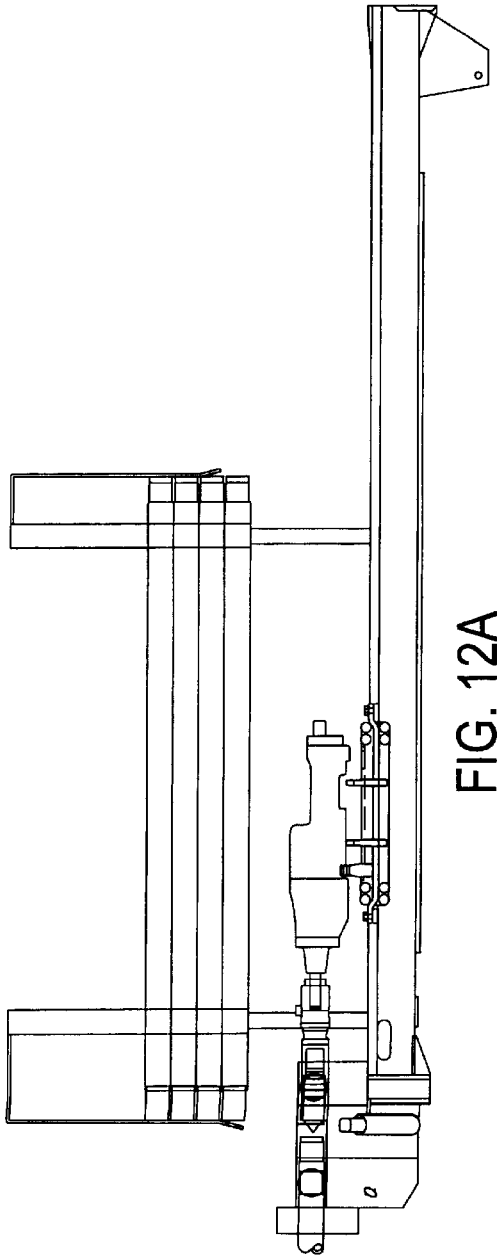
Figure 13A:
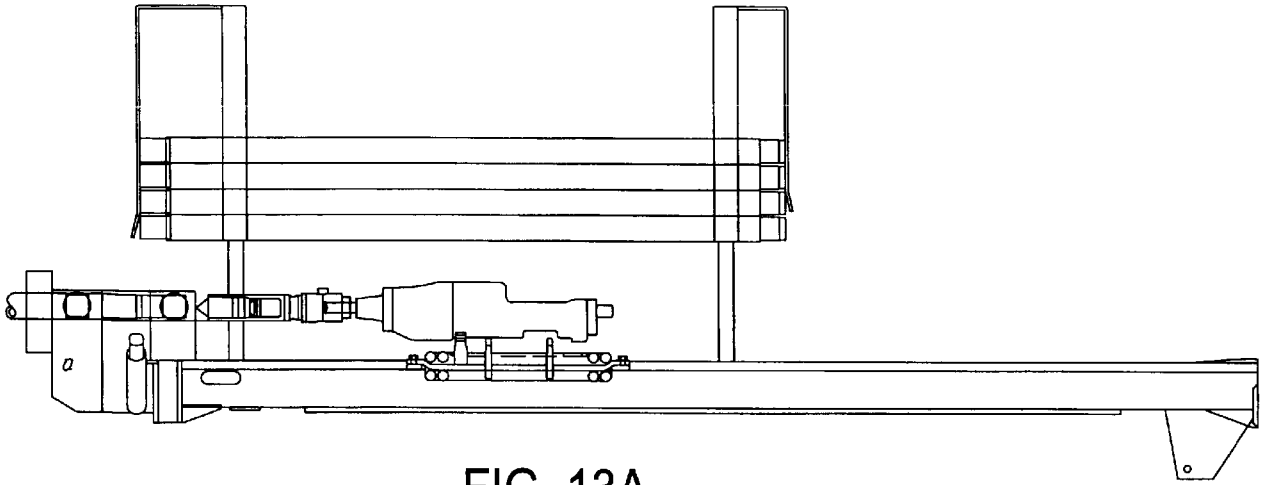
Figure 13B:
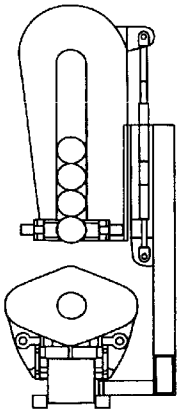
Figure 14A:
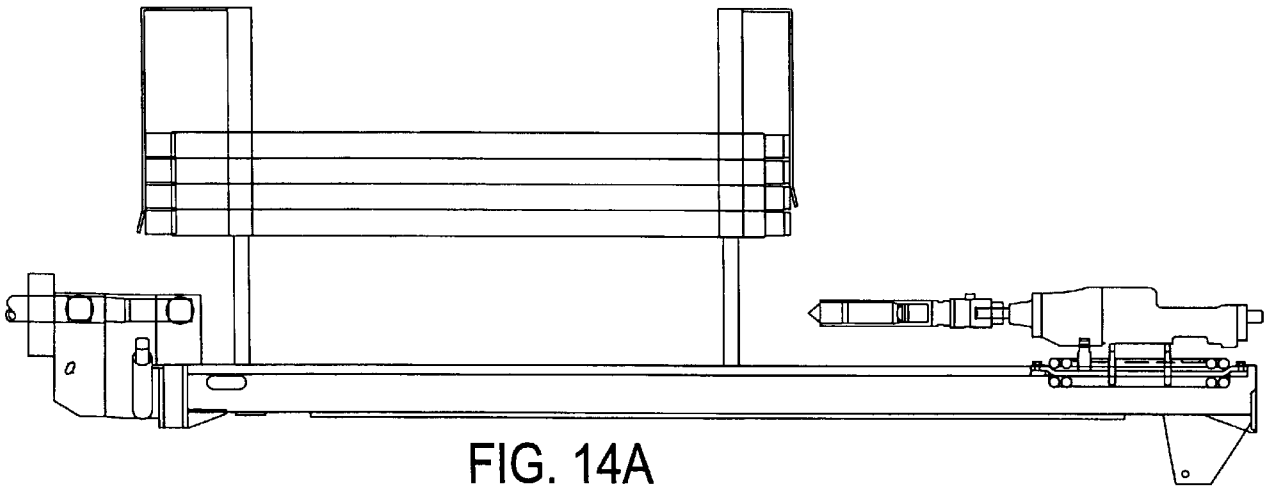
Figure 14B:
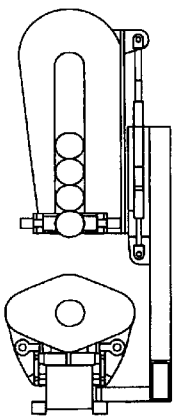

The second chuck 14 is opened (FIGS. 10A and 10B), and the drill rod is drilled by being driven by means of the drill transmission 3. In the process, the drill transmission 3 moves one stand length into its drilled-hole-side limit position (FIGS. 11A and 11B). Then, the first and second chucks 12 and 14 are closed, thus clamping the drill tube 7 which has drilled down, as well as the tube nipple 10 which has been screwed to it (FIGS. 12A and 12B). Movement of the breaker cylinder 15 loosens the screw connection. The first chuck 12 is opened, and, by means of a superimposed return and unscrewing movement of the drill transmission 3, the transmission-side tube nipple 10 is unscrewed and removed from the drill string 4 (FIGS. 13A and 13B). The drill transmission 3 moves back into its starting position (cf. FIGS. 14A and 14B), which corresponds to the position illustrated in FIG. 1.

In order for the following drill tubes 7 from the rod magazine 6 also to be fitted to the drill string 4, the procedure described above is repeated until sufficient drill tubes have been attached.

If, after the rod has been drilled down and the hole has been made in the ground, the drill string or the drill tubes are to be pulled out again, the procedure described is carried out in the reverse order.

Various drill transmissions 3 may be arranged on the drilling implement according to the invention and may differ in terms of the distance 33 between the drilling axis 9 and the mounting 2. To adapt this changeable distance 33, there is provision for it to be possible to change the position of a height-fixing means 34 on the supports 20, 21 on which the drive devices 24 act and to secure this means, for example by means of plugs or screws. In this way, the holding forks 18 can be positioned correctly via the respective drive cylinders (tandem or series cylinders).

To adapt the drilling implement to different diameters of drill tubes 7 used, there is provision for the holding forks 18 to be adapted to the particular rod diameter which is to be accommodated by means of adapter elements, such as for example screw-on or plug-on guide strips 35 (cf. FIG. 17), in that these strips 35 narrow the holding fork openings 19.

Figure 17:
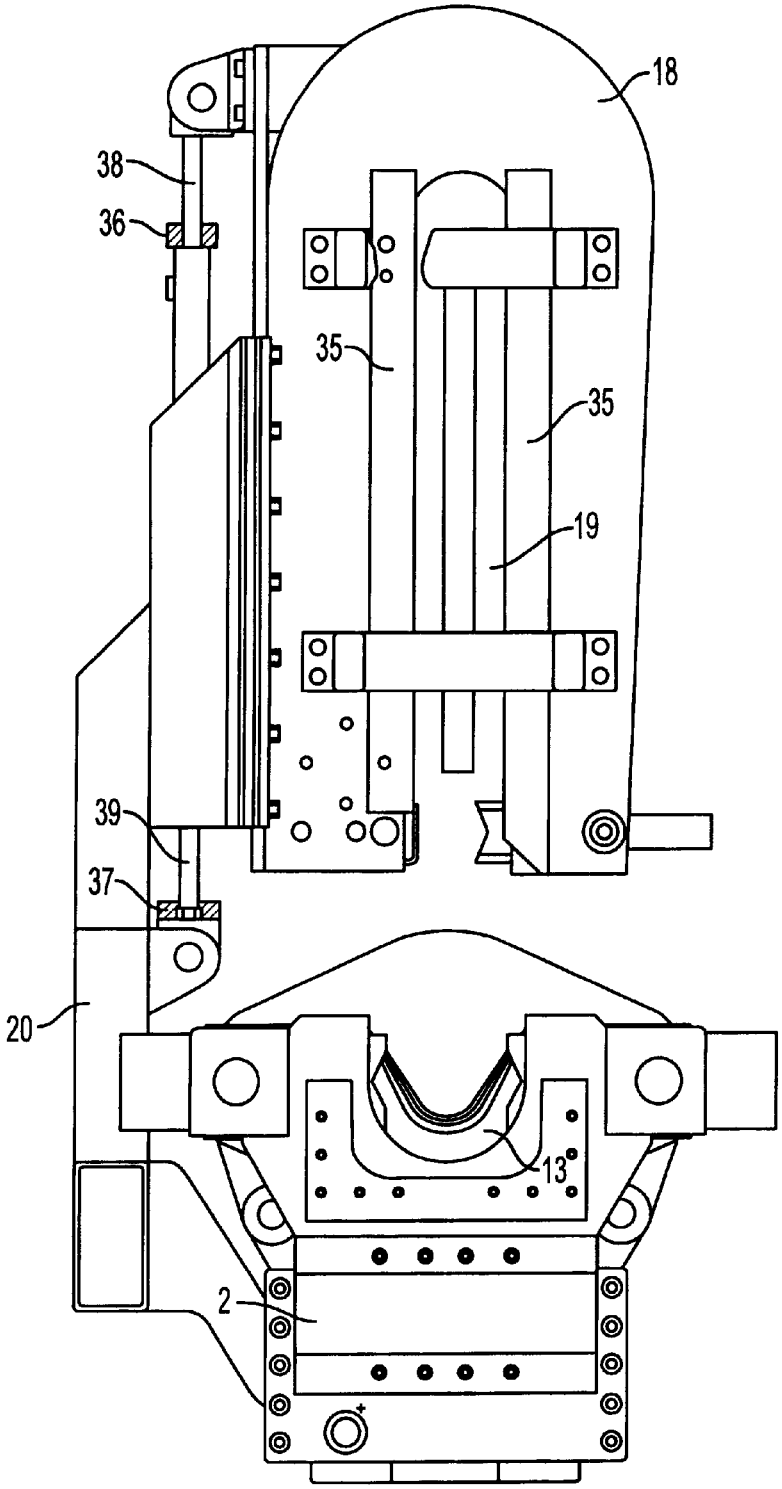
FIG. 17: shows an axial plan view of the drilling implement in accordance with FIG. 1.
Figure 18:
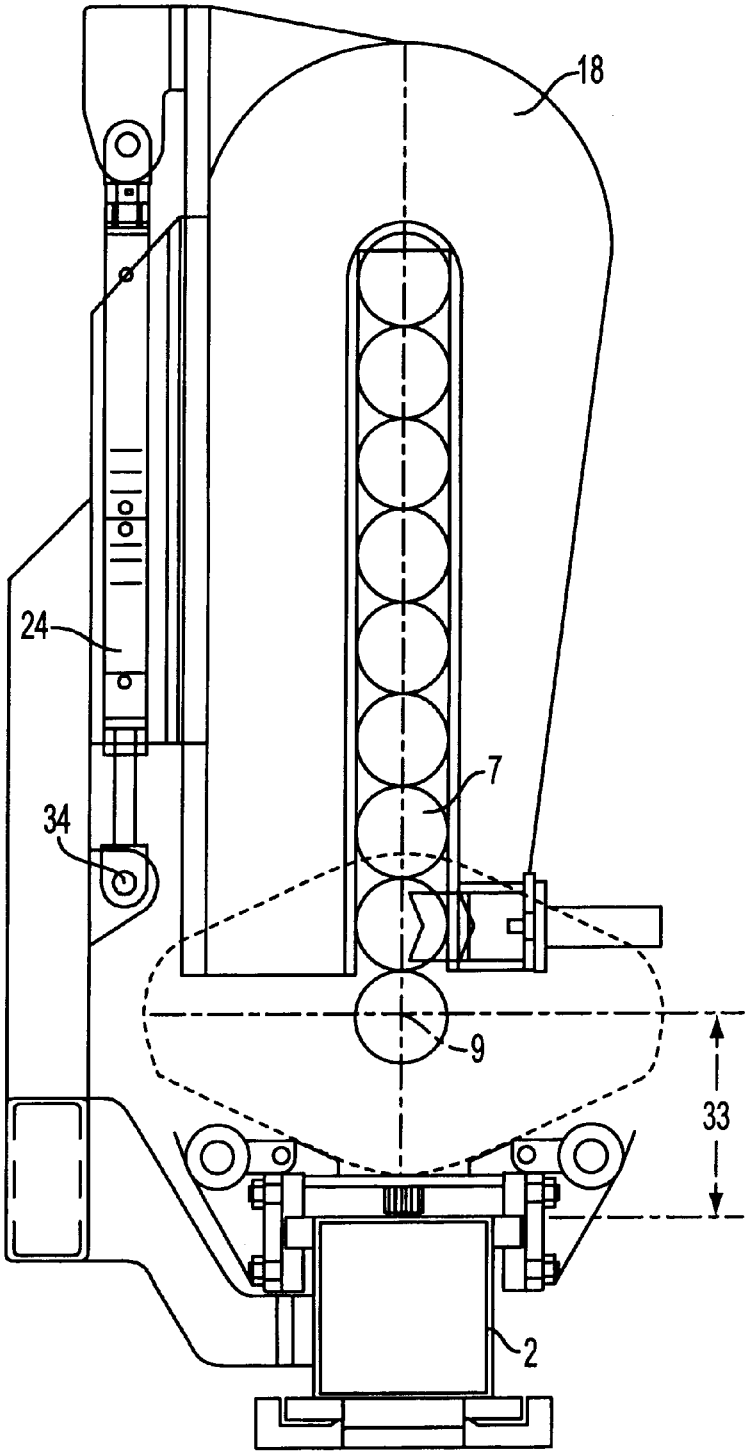
FIG. 18: shows a view in accordance with FIG. 17 of the drilling implement, with the linear magazine in an advancing position.
Figure 19:
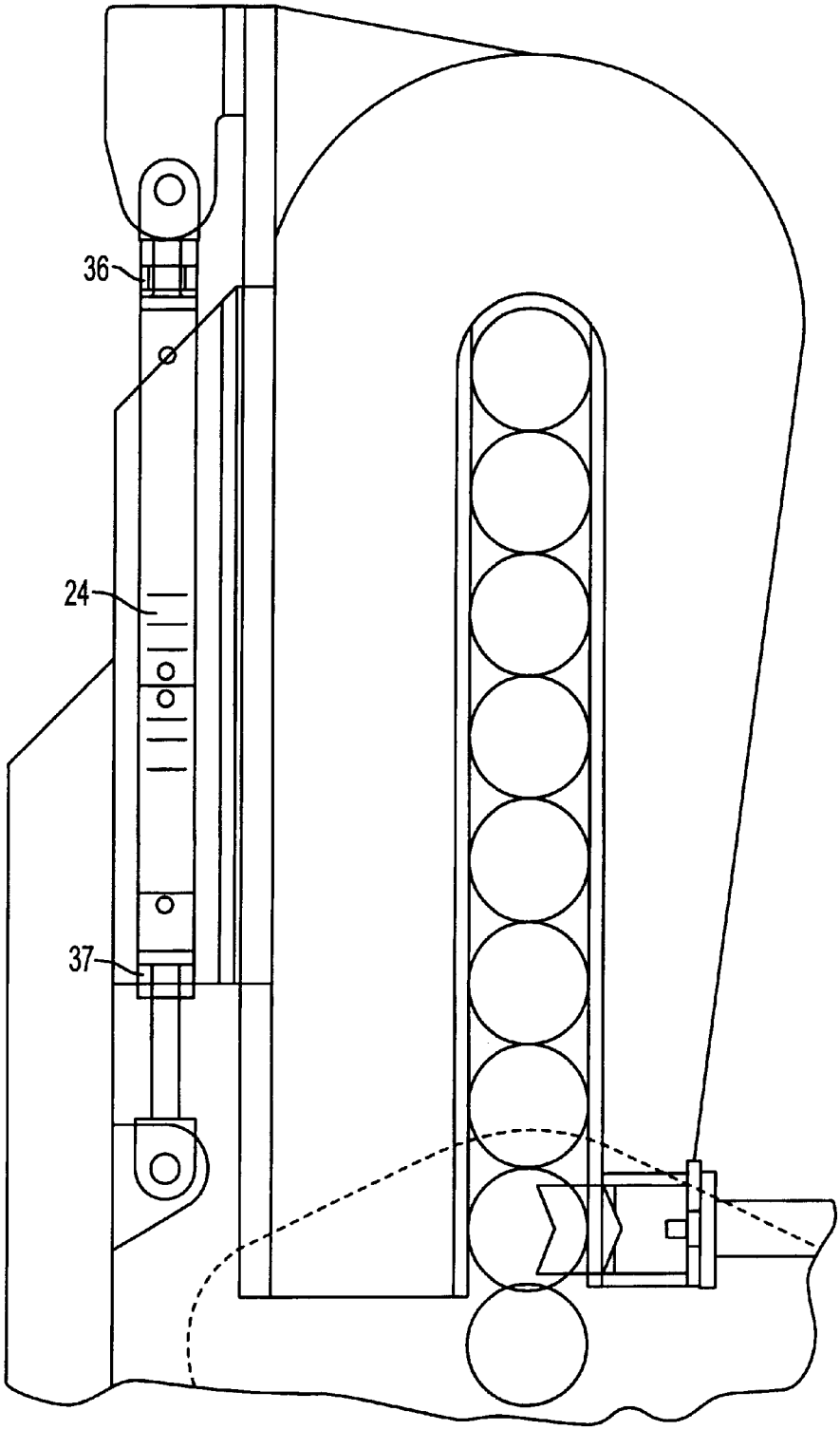
FIG. 19: shows an enlarged version of the same view of the drilling implement as that shown in FIG. 18.

The displacement path of the rod magazine 6 and of the holding forks 18 is adapted to different rod diameters by means of spacer rings 36, 37, which are arranged on the piston rods 38 and 39, respectively, of the cylinders (cf. FIG. 17). In this way, according to a reduction in diameter from a maximum diameter to a minimum diameter, the distance over which the cylinder which, via the holding forks 18, moves the drill tube 7, together with the magazine 6, into the drilling axis 9 can move is reduced, and the distance over which the cylinder which moves the holding forks 18 into the top position (starting position in accordance with FIGS. 3A and 3B, for example) is increased. A tandem cylinder as the drive device 24 is illustrated in FIG. 19.

What is claimed is:

1. A drilling implement for drilling holes in the ground, said drilling implement having a mounting;

a drill drive, which is arranged displaceably on the mounting, for drilling tools;

a linear magazine, which is arranged on the mounting, and in which the drilling tools can be stored in a plane parallel to the mounting, said linear magazine being displaceable in said plane by means of a drive device; and a clamping device for the selective rotational fixing of at least one of a fitted drill string and a drill tube which can be connected to said fitted drill string and which is arranged in a drilling axis, wherein stops are provided as mechanical travel-limiting means when the drilling tools are being positioned in respective functional positions.

2. The drilling implement as claimed in claim 1, wherein the stops are provided in the drive device for the linear magazine and fix magazining and transfer positions for the drilling tools.

3. The drilling implement as claimed in claim 1, wherein a stop is formed, as a rod support, on a stationary rod chuck of the clamping device.

4. The drilling implement as claimed in claim 3, wherein different receiving contours can be set on the rod support, in order to match different diameters of said drilling tools.

5. The drilling implement as claimed in claim 3, wherein rod supports with different receiving contours can be fitted to the rod chuck as desired.

6. The drilling implement as claimed in claim 1, wherein the linear magazine has two spaced-apart receiving devices for the drill tubes.

7. The drilling implement as claimed in claim 6, wherein the receiving devices have tube holders for clamping a drilling tool in a transfer position in the linear magazine.

8. The drilling implement as claimed in claim 7, wherein the linear magazine has a preloading device which presses the drilling tools, which are stored in the magazine toward said drilling tool which is clamped in the tube holders.

9. The drilling implement as claimed in claim 6, wherein the linear magazine can be displaced with respect to the mounting by way of receiving devices and, by means of respective limit stops on the movement paths of the drive devices, can be positioned in different functional positions.

10. The drilling implement as claimed in claim 6, wherein the receiving devices have holding forks.

11. The drilling implement as claimed in claim 10, wherein adapter elements can be fixed to the holding forks in order to adapt to different drill-tube diameters.

12. The drilling implement as claimed in claim 6, wherein the translational movement of at least one of the receiving devices and the holding forks is synchronized by mechanical synchronization of the drive devices.

13. The drilling implement as claimed in claim 1, wherein spacer rings can be fitted to the drive devices in order to adapt to different drill-tube diameters.

14. The drilling implement as claimed in claim 1, wherein it is possible to adjust the positioning of a means for attaching the drive device to a support of the mounting.

15. A drilling implement including:

a mounting;

a drill drive displaceably arranged on said mounting for at least one drilling tool;

a linear magazine, which is arranged on said mounting, and in which said at least one drilling tool can be stored in a plane parallel to the mounting, said linear magazine being displaceable in said plane by a drive device; and at least one clamping device for the selective rotational fixing of a fitted drill string and a drilling tool which can be connected to said drill string and which is arranged in a drilling axis.

16. A drilling implement including:

a mounting;

a drill drive for drilling tools, said drill drive being displaceably arranged on said mounting;

a linear magazine, which is arranged on the mounting, and in which drilling tools can be stored in a plane parallel to the mounting, said linear magazine having a preloading device that presses the drilling tools, which are stored in the magazine toward an outermost drilling tool, wherein said linear magazine is displaceable in said plane by a drive device, and is selectively positionable into three functional positions; and a clamping device for the selective rotational fixing of a fitted drill string and a drilling tool which can be connected to said drill string and which is arranged in a drilling axis.

* * * * *